US011203096B2

(12) United States Patent
Hacikyan

(10) Patent No.: US 11,203,096 B2
(45) Date of Patent: Dec. 21, 2021

(54) GLASS GRINDING APPARATUS

(71) Applicant: Michael Hacikyan, Naples, FL (US)

(72) Inventor: Michael Hacikyan, Naples, FL (US)

( * ) Notice: Subject to any disclaimer, the term of this patent is extended or adjusted under 35 U.S.C. 154(b) by 587 days.

(21) Appl. No.: 15/944,747

(22) Filed: Apr. 3, 2018

(65) Prior Publication Data

US 2019/0299359 A1 Oct. 3, 2019

(51) Int. Cl.
*B24B 41/06* (2012.01)
*B24B 9/08* (2006.01)

(52) U.S. Cl.
CPC ..... *B24B 41/068* (2013.01); *B24B 9/08* (2013.01)

(58) Field of Classification Search
CPC B24B 41/068; B24B 9/08; B24B 9/06; B24B 9/10
See application file for complete search history.

(56) References Cited

U.S. PATENT DOCUMENTS 2,604,823 A 7/1952 Szypulinski
2,790,271 A 4/1957 Samson
3,123,950 A 3/1964 Kuris
3,905,159 A 9/1975 Stanaback
3,977,127 A 8/1976 Mahnken
4,423,568 A 1/1984 Gould
4,516,357 A 5/1985 Gach
4,543,021 A 9/1985 Adler
4,551,948 A 11/1985 Kindig et al.
4,884,927 A 12/1989 Menker
5,035,087 A 7/1991 Nishiguchi et al.
5,056,969 A 10/1991 Nerland et al.
(Continued)

FOREIGN PATENT DOCUMENTS

JP 2001028351 1/2001

OTHER PUBLICATIONS

ISA/KR International Application Division, "Notification of Transmittal of the International Search Report and the Written Opinion of the International Searching Authority, or the Declaration", PCT/US2019/022866 claiming priority to U.S. Appl. No. 15/944,747, dated Jul. 30, 2019, 12 pages.
(Continued)

*Primary Examiner* — Dung Van Nguyen
(74) *Attorney, Agent, or Firm* — Walter W. Duft

(57) ABSTRACT

A glass grinding apparatus includes a base unit assembly having a work-piece support assembly and a motor housing assembly. The work-piece support assembly includes a work-piece support grating and a water basin. The motor housing assembly includes a motor housing containing a grinding motor and a power supply. The grinding motor has a rotatable motor shaft whose upper end is configured to receive a glass grinding bit operable to grind a glass work-piece situated on the work-piece support grating. In one aspect, the grinding motor operates on direct current provided by an AC/DC power supply that is directly operable with different utility mains. In another aspect, the work-piece support assembly is a discrete unit having lifting handles. In another aspect, the work-piece support grating has water-restriction baffles and/or a water-level view port. In another aspect, an integrated lamp-shield assembly is provided. In another aspect, a self-contained pedestal assembly is provided.

24 Claims, 13 Drawing Sheets

(56) References Cited

U.S. PATENT DOCUMENTS

| | | | | | |
|---|---|---|---|---|---|
| 5,207,030 | A * | 5/1993 | Herrmann | B24B 9/08 | 269/254 R |
| 5,241,791 | A | 9/1993 | Lacy | | |
| 5,251,407 | A | 10/1993 | Afshar | | |
| 5,342,156 | A | 8/1994 | Baba | | |
| 5,345,726 | A | 9/1994 | Gach | | |
| 5,409,417 | A | 4/1995 | Bando | | |
| 5,423,359 | A | 6/1995 | Aigner | | |
| 5,527,207 | A | 6/1996 | Azar et al. | | |
| 5,549,509 | A * | 8/1996 | Hirst | B24B 7/08 | 451/178 |
| 5,609,512 | A | 3/1997 | Holmes et al. | | |
| 5,616,071 | A * | 4/1997 | Herrmann | B24B 9/08 | 451/259 |
| 5,681,211 | A * | 10/1997 | Wiand | B24B 7/08 | 451/177 |
| 6,083,086 | A | 7/2000 | Hacikyan | | |
| 6,123,606 | A | 9/2000 | Hill et al. | | |
| 6,176,656 | B1 | 1/2001 | Seong | | |
| 6,241,589 | B1 | 6/2001 | Hacikyan | | |
| 6,416,394 | B1 | 7/2002 | Hacikyan | | |
| 6,629,877 | B2 * | 10/2003 | Cerniway | B24B 9/107 | 451/177 |
| 6,896,601 | B2 | 5/2005 | Hacikyan | | |
| 6,994,613 | B2 * | 2/2006 | Hacikyan | B24B 9/08 | 451/358 |
| 7,125,328 | B1 * | 10/2006 | Hacikyan | B24B 9/10 | 451/541 |
| 10,277,114 | B2 * | 4/2019 | Pant | H02P 23/26 | |
| 2002/0119736 | A1 | 8/2002 | Cerniway | | |
| 2009/0121550 | A1 * | 5/2009 | Riviera | H02J 7/0068 | 307/66 |
| 2011/0217908 | A1 | 9/2011 | Chen | | |
| 2012/0104981 | A1 * | 5/2012 | Tseng | H02M 3/33523 | 318/400.3 |
| 2014/0203755 | A1 * | 7/2014 | Becerra | H02M 5/458 | 318/812 |

OTHER PUBLICATIONS

Diamond Tech International, "Diamond Max Two-in-One Grinder Operations Manual", at least as early as Mar. 10, 2018, 4 pages.

* cited by examiner

GLASS GRINDING APPARATUS

BACKGROUND

1. Field

The present invention relates generally to grinding apparatus. More particularly, the invention concerns glass grinding apparatus, and especially table top grinders for use by hobbyists in the fabrication of glass artwork and decorative glass products.

2. Description of the Prior Art

By way of background, there are a wide variety of grinding apparatus for shaping and/or surfacing many different kinds of materials. Of particular interest herein are table-top grinders of the type used by glass hobbyists and the like for producing glass artwork and other decorative glass products, including but not limited to stained glass products. Commonly assigned U.S. Pat. No. 6,416,394, entitled "Planer/Grinder For Glass," and U.S. Pat. No. 6,994,613, entitled "Grinding Apparatus With Splash Protector And Improved Fluid Delivery System," exemplify such equipment. The entire contents of each patent are incorporated herein by this reference. The typical glass grinding apparatus includes a cylindrical grinding bit mounted on a vertically-oriented, motor-driven shaft that spins above a horizontal work piece platform. The grinding bit can be formed with a surface coating of diamonds or other abrasive particles capable of grinding, sanding or polishing glass. A glass work piece that is to be shaped or otherwise treated is placed on the platform and advanced until its edge contacts the grinding bit. By maneuvering the work piece relative to the grinding bit, material can be selectively removed from the work piece edge to create a desired shape and/or surface treatment. Because the grinding process generates both heat and grinding debris, an irrigation fluid such as water is typically used to cool and wash the grinding bit during the grinding process. Because the grinding debris combines with the irrigation fluid to form a sludge that sprays outwardly from the grinding bit, a splash curtain and an eye shield may be used to respectively contain such material to the work area and away from the user's face.

It is to improvements in the design of table-top glass grinders that the presently disclosed subject matter is directed.

SUMMARY

A glass grinding apparatus as disclosed herein may include a base unit assembly having a work-piece support assembly mounted on a motor housing assembly. The work-piece support assembly may include a work-piece support grating and a water basin. The motor housing assembly may include a motor housing having disposed therein a grinding motor and a power supply. The grinding motor may have a rotatable motor shaft extending upwardly from the motor housing assembly through an aperture in the work-piece support assembly. The motor shaft may have an upper end configured to receive a glass grinding bit that is operable to grind a glass work-piece when the work-piece is situated on the support grating.

In one aspect, the grinding motor may be a direct current motor and the power supply may be a direct current power supply operable to convert alternating current from different utility mains having different voltage and frequency characteristics into direct current at a substantially uniform voltage for powering the direct current motor.

In another aspect, the water basin may include handles for lifting and carrying. The work-piece support assembly may rest on the motor housing assembly and be removable therefrom by way of lifting in order to allow the water basin to be carried to a water source for filling with water without having to carry the motor housing assembly.

In another aspect, the support grating may include plural water-restriction baffles extending from an underside thereof for reducing water spillage from the water basin when the water basin is removed from the motor housing assembly.

In another aspect, the support grating may include at least one water level view port for indicating a level of water in the water basin.

In another aspect, a lamp-shield assembly may be mounted on the base unit assembly. The lamp-shield assembly may include an eye shield and a work-piece illumination lamp.

In another aspect, a pedestal assembly may be removably mounted on the work-piece support assembly for use when grinding a small work-piece using a reduced-size grinding bit. The pedestal assembly may include a pedestal work-piece support grating, a pedestal water basin, and a pedestal bit-lubricating device arranged to deliver the water in the pedestal water basin to the reduced-size grinding bit when the bit is mounted on the motor shaft.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
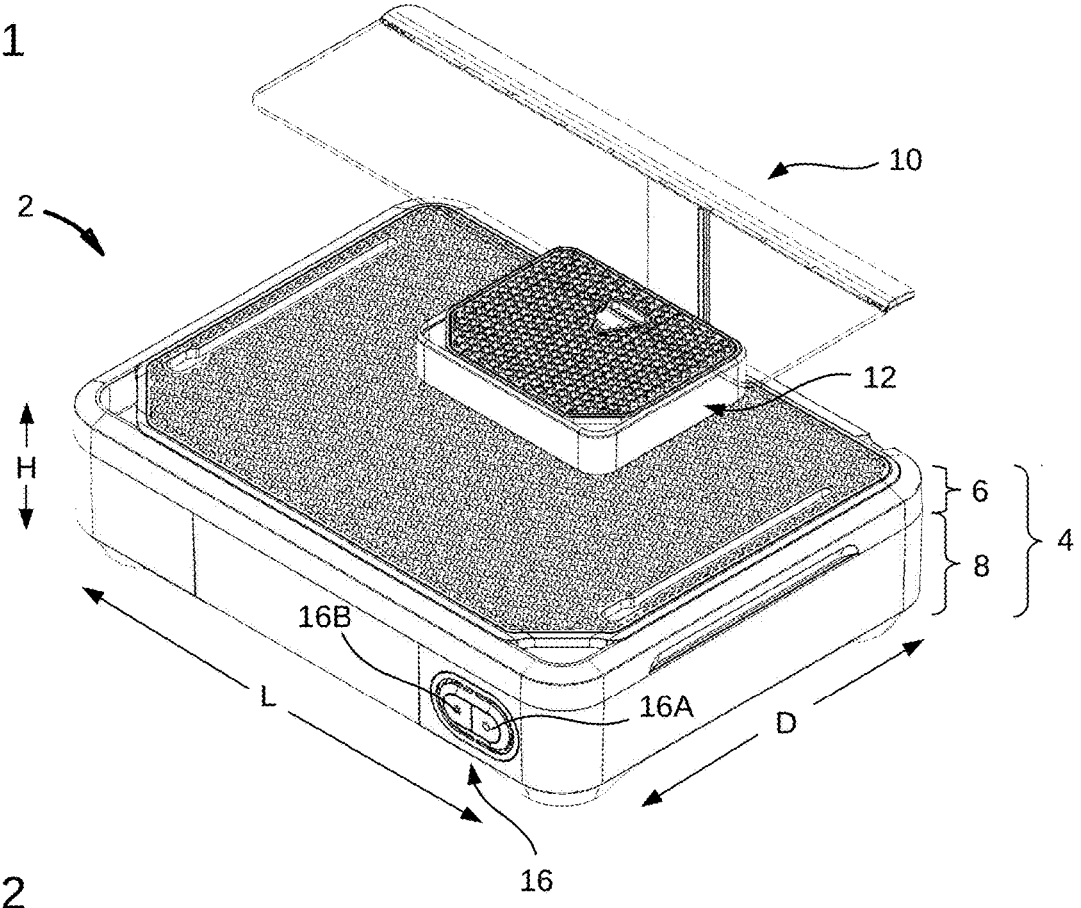
FIG. 1 is an upper perspective view of a glass grinding apparatus according an example embodiment.
Figure 2:
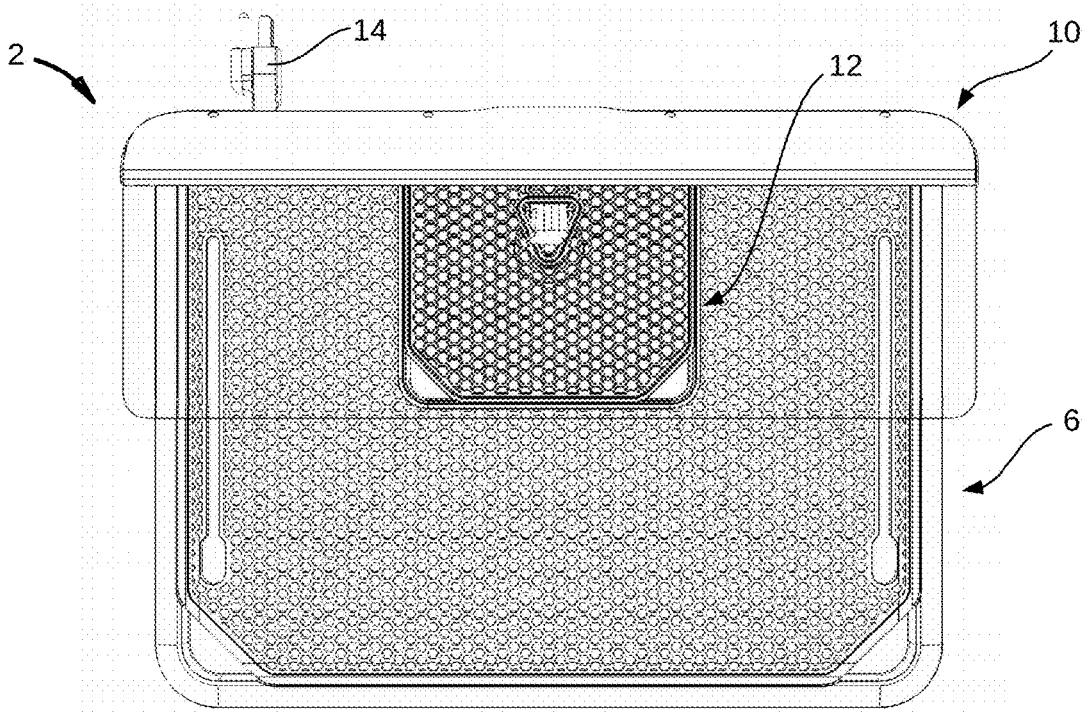
FIG. 2 is a top plan view of the grinding apparatus of FIG. 1.
Figure 3:
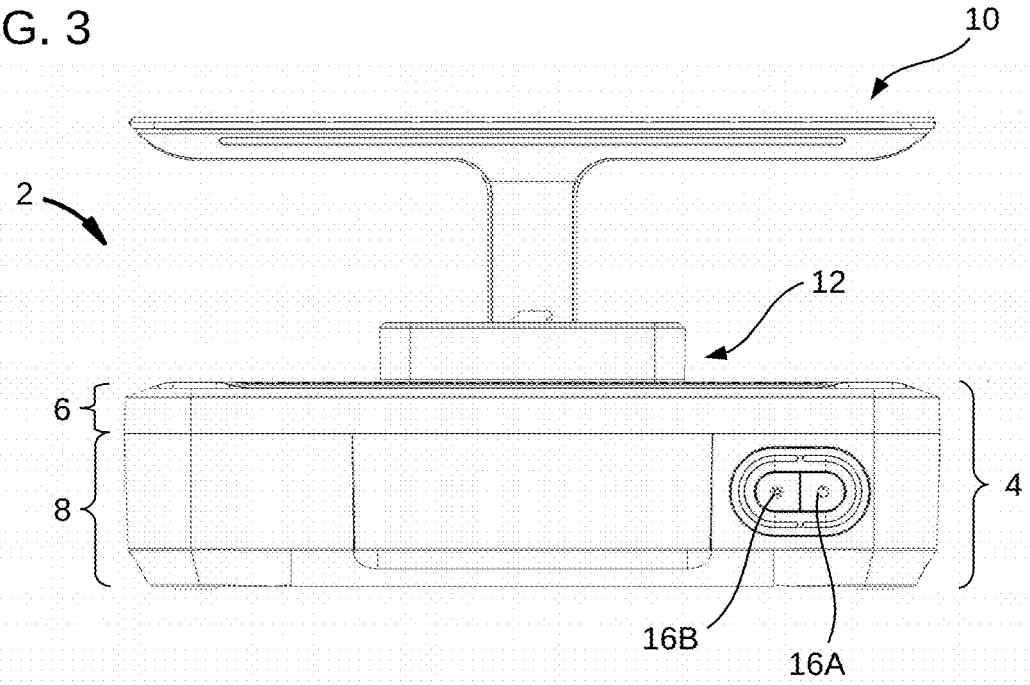
FIG. 3 is a front elevation view of the grinding apparatus of FIG. 1.
Figure 4:
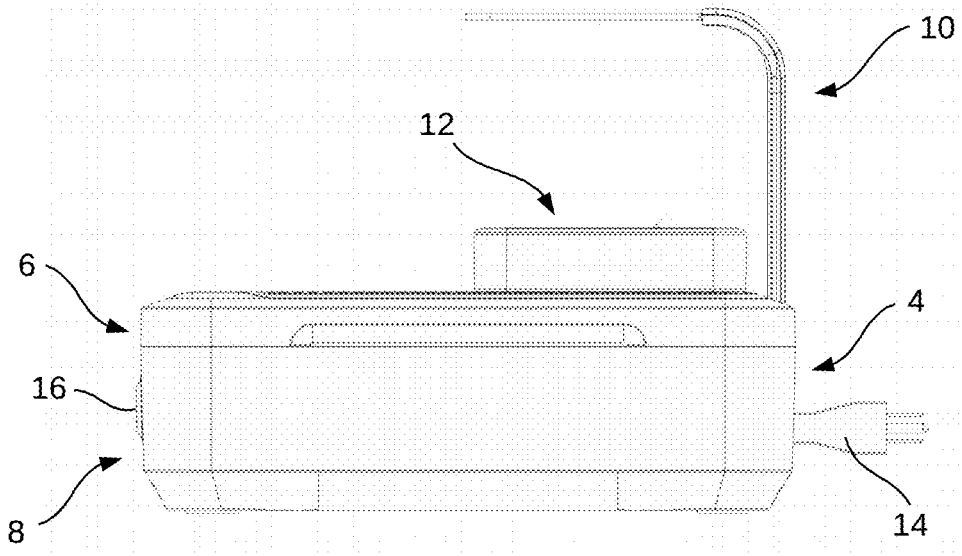
FIG. 4 is a right-side elevation view of the grinding apparatus of FIG. 1.
Figure 5:
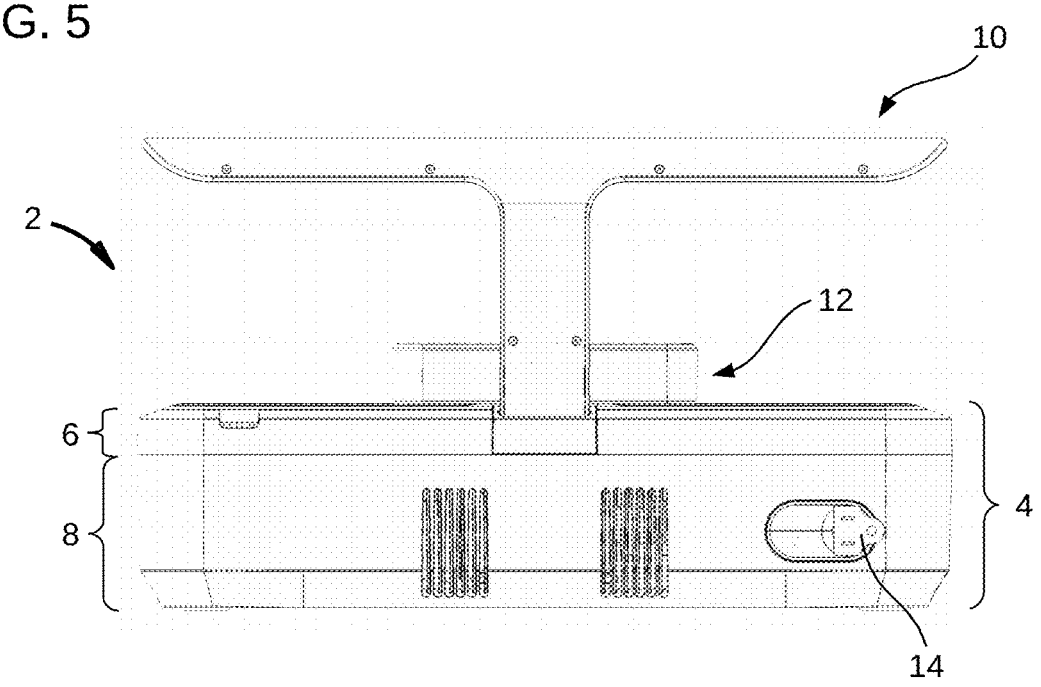
FIG. 5 is a rear elevation view of the grinding apparatus of FIG. 1.
Figure 6:
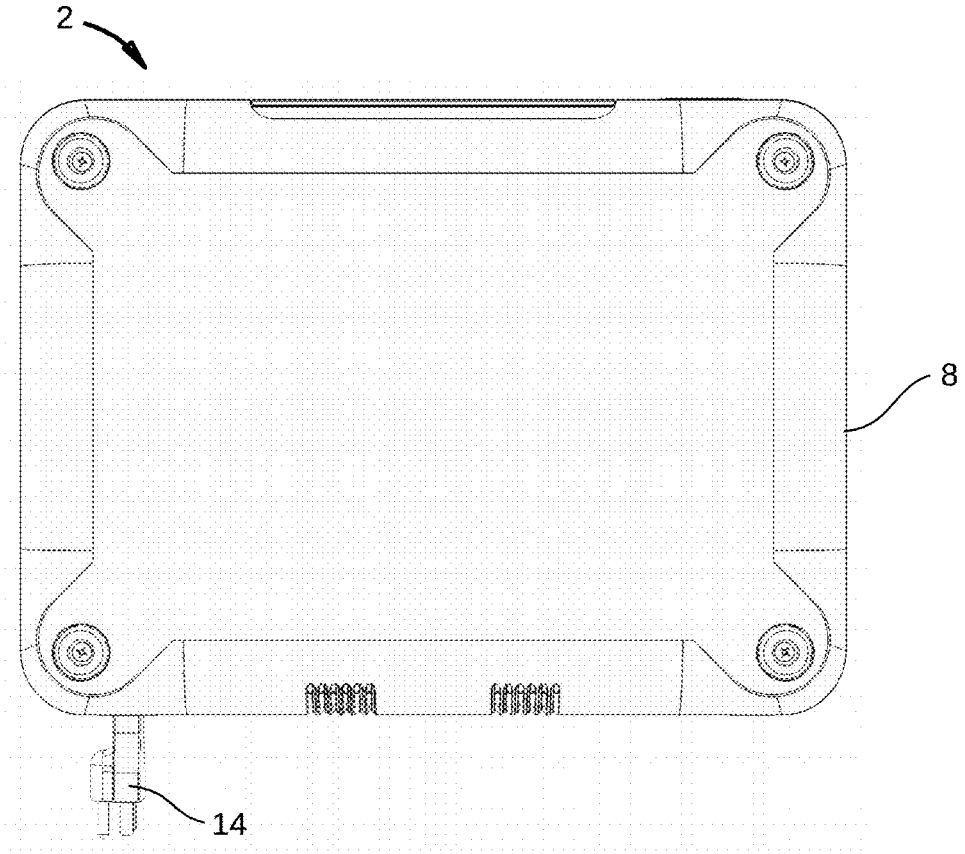
FIG. 6 is a bottom plan view of the grinding apparatus of FIG. 1.

Turning now to the drawing figures, which are not necessarily to scale, like reference numbers are used to represent like elements in all of the several views.

FIGS. 1-6 illustrate a glass grinding apparatus 2 that may be constructed in accordance an example embodiment of the present disclosure. In this embodiment, the major structural components of the glass grinding apparatus 2 may be constructed from molded plastics of suitable rigidity and strength. Other embodiments could utilize other structural materials, such as metals or composites, depending on manufacturer preferences.

The glass grinding apparatus 2 may include a base unit assembly 4 having a work-piece support assembly 6 and a motor housing assembly 8. The base unit assembly 4 may be of generally rectangular shape. As shown in FIG. 1, the generally rectangular shape of the base unit assembly 4 may provide width dimension W, a depth dimension D, and a height dimension H. The width dimension W may be comparable in size to the depth dimension D, with the latter being slightly less than the former if so desired. By comparison, the height dimension may be relatively small in comparison to the width and the depth dimensions so as to provide a stylish low-profile appearance. For example, the height dimension might be no more than one-half the width or depth dimensions. Without limitation, and for purposes of illustration only, a specific construction of the base unit assembly 4 might have a width dimension of approximately 12-16 inches, a depth dimension of approximately 10-14 inches, and the height dimension of approximately 3-5 inches.

As will become apparent from the description to follow, the work-piece support assembly 6 provides a support surface on which a glass work-piece (not shown) may be placed during grinding operations. The work-piece support assembly 6 also includes its own water supply for use in lubricating a glass grinding bit (see FIGS. 7, 16 and 21) during grinding operations. As will also become apparent from the description to follow, the motor housing assembly houses a grinding motor and other electrical components (not shown in FIGS. 1-6) for providing motive power to the grinding bit.

Additional components of the glass grinding apparatus 2 may include an optional lamp-shield assembly 10 that can be mounted on the motor housing assembly 8, and an optional pedestal assembly 12 that can be placed on the work-piece support assembly 6. A retractable power connector 14 may be provided in the motor housing assembly 8 to connect the glass grinding apparatus 2 to a suitable power source, such as a utility mains supplying alternating current electricity. A power switch 16 may be provided on the motor housing assembly 8 to selectively activate the grinding motor disposed within the motor housing 8 and a work-piece illumination lamp disposed in the lamp-shield assembly 10. In the illustrated embodiment, the power switch 16 includes first and second buttons 16A and 16B that may be separately operated to selectively activate the grinding motor and the work-piece illumination lamp.

Figure 7:
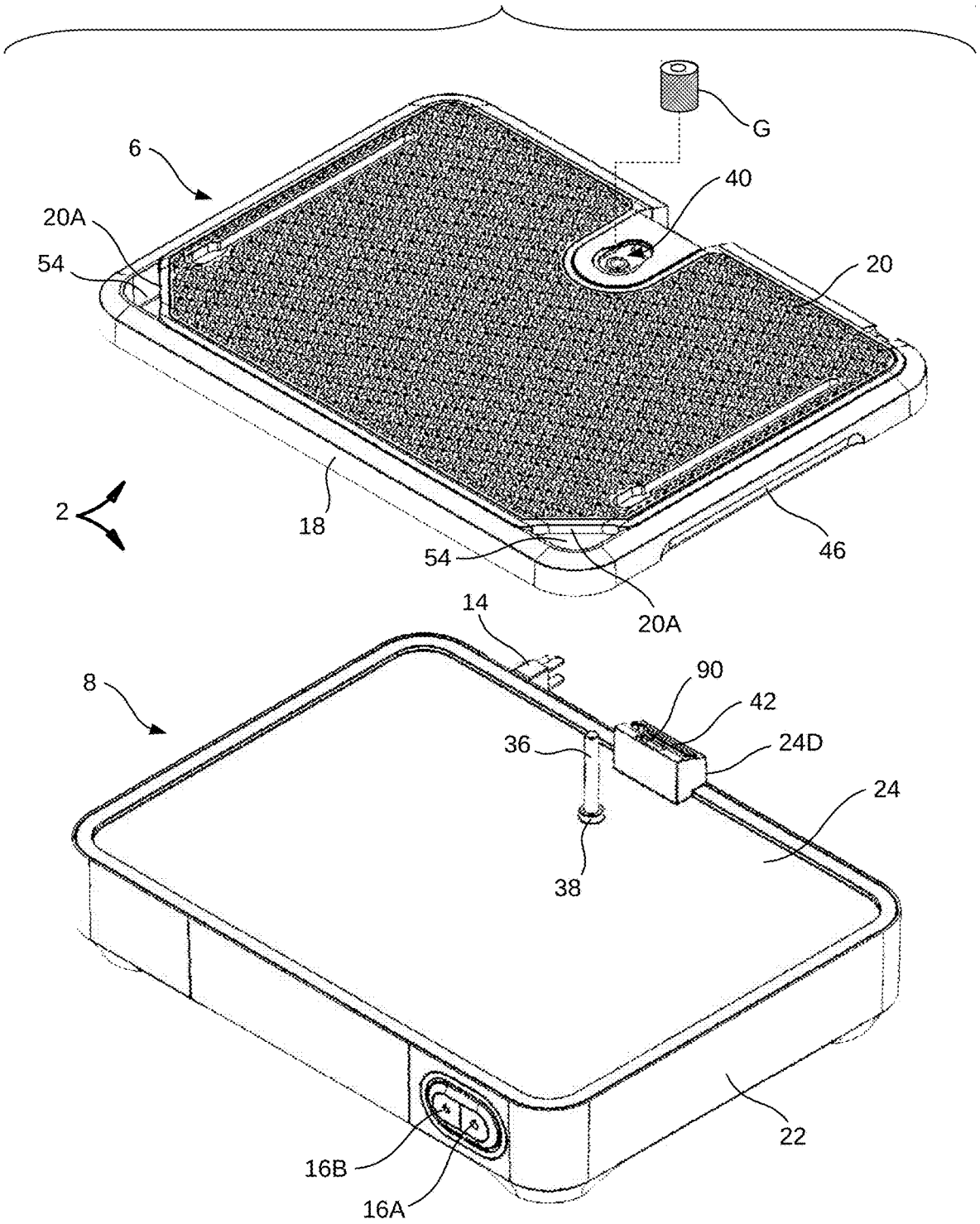
FIG. 7 is an exploded upper perspective view of an example base unit assembly of the grinding apparatus of FIG. 1, showing an example work-piece support assembly separated from an example motor housing assembly.
Figure 9:
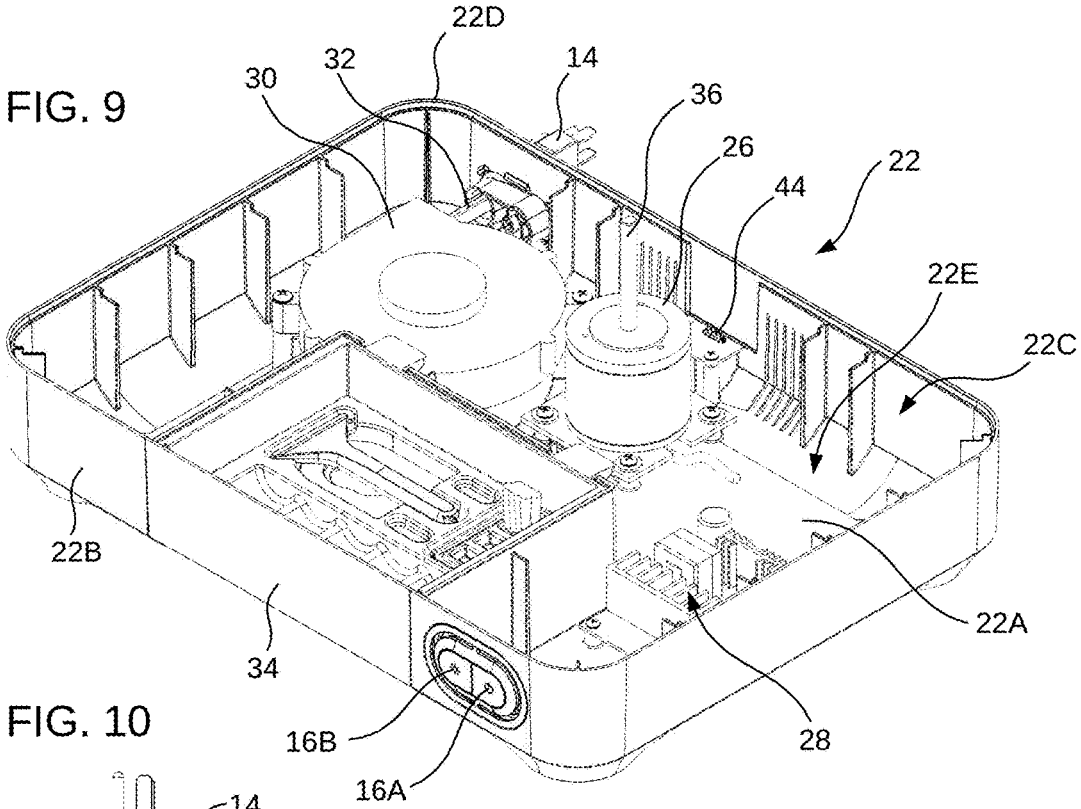
FIG. 9 is an upper perspective view of the motor housing of FIG. 8, showing the drive motor and power components.
Figure 10:
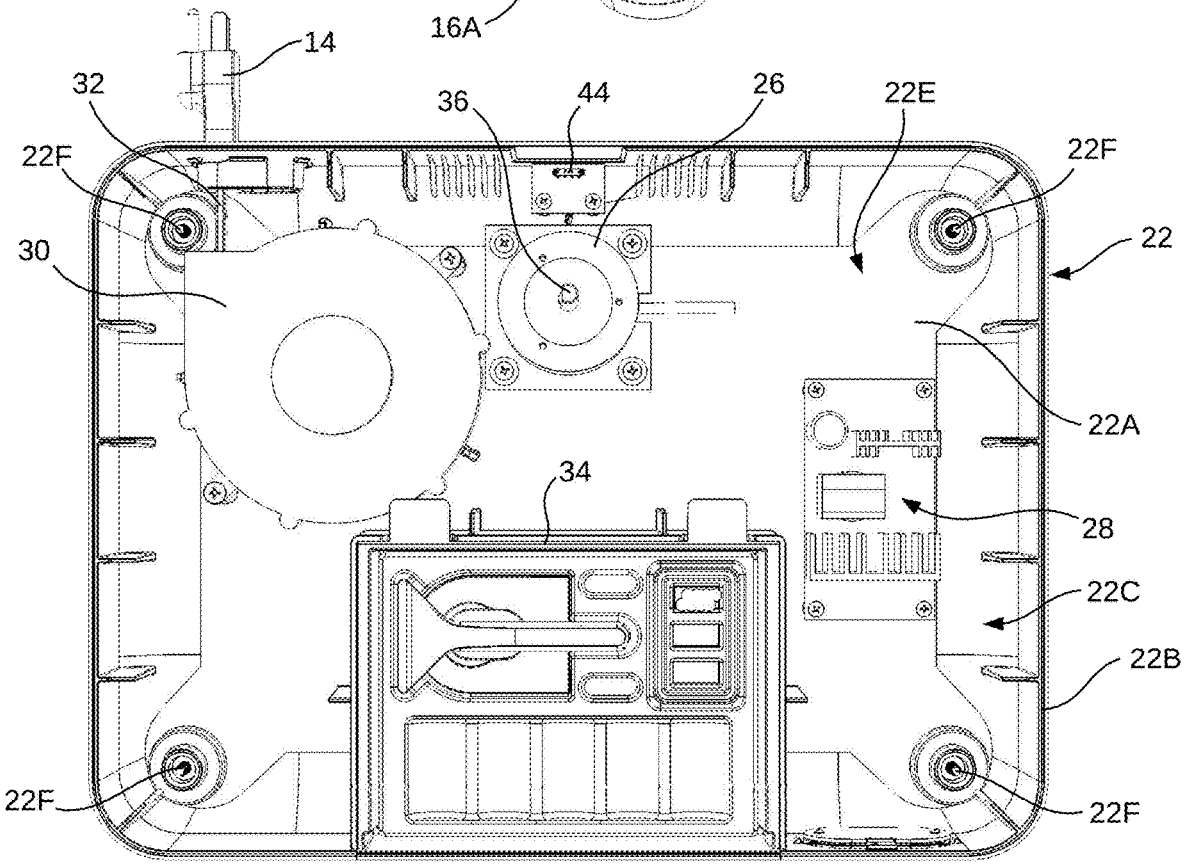
FIG. 10 is an upper plan view of the motor housing of FIG. 9, showing the drive motor and power components.

Turning now to FIG. 7, the work-piece support assembly 6 is preferably removable from the motor housing assembly 8, as by lifting. As described in more detail below, the work-piece support assembly 6 may include a self-contained water basin 18 and a work-piece support grating 20 that is removably mounted thereon. With additional reference to FIGS. 8-10, the motor housing assembly 8 may include a generally rectangular motor housing 22 having a closed bottom 22A, a continuous sidewall 22B, and an open top 22C defined by an upper rim 22D of the sidewall. The motor housing's open top 22C may be covered by a support tray cover 24 that may be removably supported on the motor housing's upper rim 22D for ready access to an interior 22E of the motor housing 22.

Disposed within the motor housing interior 22E is a grinding motor 26 and a power supply 28. Also disposed within the motor housing interior 22E is a power cord retraction unit 30 on which a power cord 32 (terminating at the power connector 14) is retractably wound. The motor housing interior 22E may also house an optional utility drawer 34 for storing grinding bits and other supplies.

Figure 8:
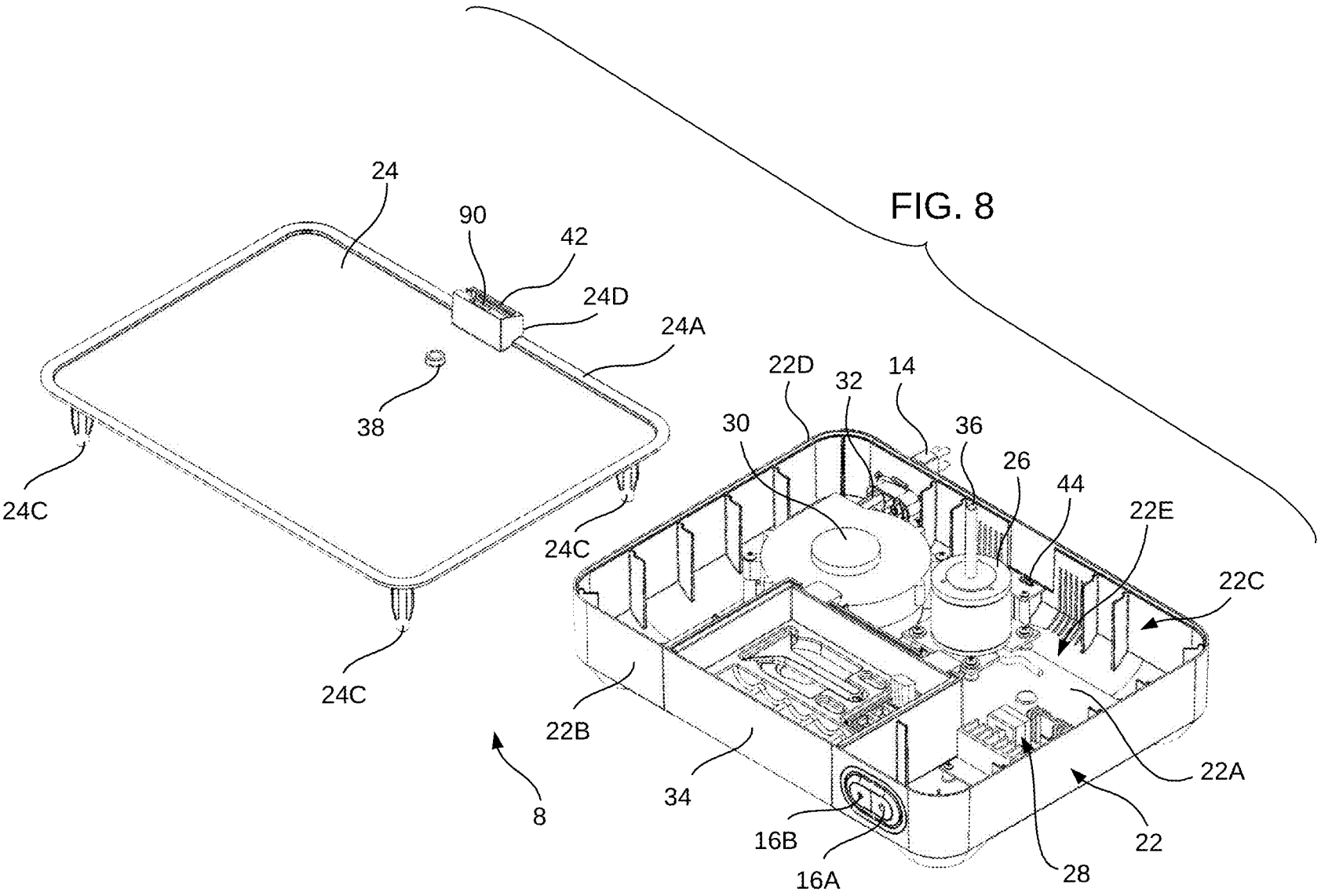
FIG. 8 is an exploded upper perspective view of the motor housing assembly of FIG. 7, showing a support tray cover separated from a motor housing containing a drive motor and power components.

As best shown in FIG. 8, the grinding motor 26 has an upwardly-extending rotatable motor shaft 36 that extends through a first motor shaft aperture 38 in the support tray cover 24. As best shown in FIG. 7, the grinding motor shaft 36 is further accommodated by a second motor shaft aperture 40 in the work-piece support assembly 6. The upper end of the grinding motor shaft 36 is configured to receive a glass grinding bit that is operable to grind a glass work-piece when the work-piece is situated on the work-piece support grating 20. The motor shaft's upper end may be suitably keyed, such as by providing a flat surface on the otherwise cylindrical shaft, in order to ensure that the grinding bit does not slip on the grinding motor shaft 36 as it rotates. Other shaft-bit registration configurations may also be used.

In FIGS. 7-8, the support tray cover 24 is shown to be generally rectangular in shape to match the rectangular shape of the motor housing 22. The support tray cover 24 may have a tray-like configuration that includes a raised peripheral ridge 24A surrounding a lower central portion 24B that is substantially flat. The peripheral ridge 22A may be sized to fit onto the upper rim 22D of the motor housing 22 so that the central portion 22B sits below the upper rim and is captured thereby in order to prevent the support tray cover 24 from displacing laterally. To provide vertical support and stability, the support tray cover 24 may be provided with plural stand-off pins 24C that are configured to slidably engage corresponding pin mounts 22F (see FIG. 10) formed on the bottom 22A of the motor housing 22. In the illustrated embodiment, the pin mounts 22F may be formed with short cylindrical posts that engage corresponding bores (not shown) formed in the stand-off pins 24C. Other mounting arrangements may also be used.

With continuing reference to FIGS. 7-8, the support tray cover 24 may further include an upwardly-protruding structure 24D on one side of the peripheral ridge 24A that provides a support base for the lamp-shield assembly 10 of FIGS. 1-6. The lamp-shield support base 24D may have a lamp-shield receptacle 42 therein that is configured to slidably receive an upright frame portion of the lamp-shield assembly 10. The lamp-shield receptacle 42 supports the lamp-shield assembly and aligns an electrical connector on the upright frame portion's lower end (see element 72 of FIG. 17) with an electrical connector 44 situated in the motor housing interior 22E.

According to one aspect of the glass grinding apparatus 2, the grinding motor 26 may be implemented as a direct current (DC) motor, and the power supply 28 may be an alternating current/direct current (AC/DC) power supply powered directly from a utility mains without any intervening electrical conditioning equipment. The AC/DC power supply 28 may be operable to convert alternating current from different utility mains having different voltage and frequency characteristics into direct current at a substantially uniform voltage for powering the DC grinding motor 26. An advantage of using a DC grinding motor 26 is that it can operate at higher speeds and produce greater starting torque than a conventional AC motor of the type currently used for table-top glass grinding apparatus designed for hobbyist use. A conventional table-top glass grinder AC motor may reach a maximum speed of approximately 3500 rpm and produce a maximum torque of approximately 0.3 N-m (42 oz-in). Such AC motors are designed to run directly off of AC utility mains power at a specified voltage and frequency, such as either 110 volts/60 cycles or 220 volts/50 cycles, but not both. Cooling fans are typically required for heat dissipation. Cooling fans are not required for the DC grinding motor 26, and thus the glass grinding apparatus 2 may be implemented as a fan-free device.

In an example embodiment, the direct current grinding motor 26 may be implemented using a DC motor capable of operating at higher speed and torque than conventional AC motors used in table-top glass grinders. For example, the grinding motor 26 may be a 24 volt DC motor operable at a speed of approximately 5000 rpm or more (without gearing), that can generate a torque of approximately 0.6 N-m (70 oz-in) or more at substantially all rotational speeds. This is quite advantageous because higher motor speed means less chipping of the glass work-piece, and greater torque means more grinding pressure may be applied to the work-piece for faster grinding. DC motors having other operating specifications may also be used.

In an example embodiment, the AC/DC power supply 28 may be implemented as a switched mode power supply (SMPS) capable of delivering a direct current output of substantially constant voltage from an alternating current input that may vary widely in voltage and frequency. For example, the AC/DC power supply 26 may be capable of delivering a DC output of approximately 24 DC volts and approximately 4 amperes from an AC input whose voltage may range between approximately 85-240 volts, and whose frequency may range between approximately 50-60 Hz. AC/DC power supplies having other operating specifications may also be used.

Advantageously, using a DC grinding motor and a variable input voltage/constant output voltage AC/DC power supply allows the glass grinding apparatus 2 to be used virtually anywhere in the world without a voltage converter. In contrast, conventional table-top glass grinding apparatus powered by AC motors designed for direct connection to a utility mains are restricted to particular voltages and frequencies. Manufacturers must either produce different glass grinding apparatus models designed for different countries, or the end user must operate the grinding apparatus with either step-up or step-down power conversion equipment. The glass grinding apparatus 2 thus has the advantage of reducing manufacturing costs and/or simplifying the end user experience.

According to another aspect of the glass grinding apparatus 2, the water basin 18 shown in FIG. 7 may be configured to include lifting handles 46 for easy lifting and carrying of the work-piece support assembly 6. In this way, the work-piece support assembly 6 may designed to rest on the motor housing assembly 8 (with or without some form of affirmative locking) and be removable therefrom by way of lifting via the handles 46. This advantageously allows the water basin 18 to be carried to a water source for filling with water without having to carry the motor housing assembly. As previously noted, water is used to lubricate the grinding bit during grinding operations, and the water basin 18 provides a convenient water repository immediately below the work-piece support grating 20. In the illustrated embodiment, the lifting handles 46 are implemented as elongated horizontal finger grooves. The lifting handles 46 are therefore recessed. Other lifting handle configurations, including protruding handles, could also be used.

Figure 11:
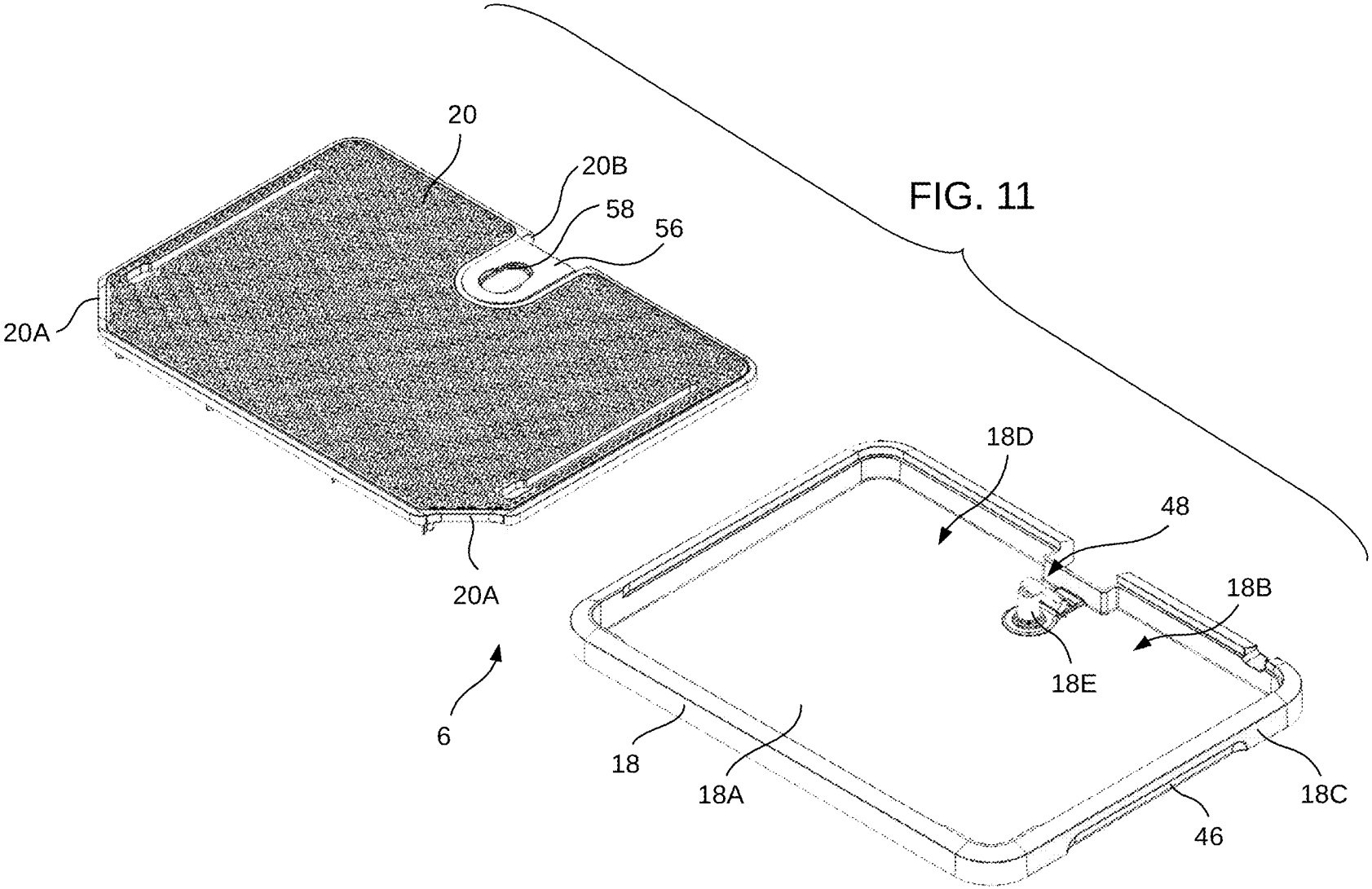
FIG. 11 is an exploded upper perspective view of the work-piece support assembly of FIG. 7, showing an example work-piece support grating separated from an example water basin.

Turning now to FIG. 11, the work-piece support assembly 2 is shown with the work-piece support grating 20 separated from the water basin 18. As can be seen, the water basin 18 may be configured as a generally rectangular tray structure having a substantially closed bottom 18A, an open top 18B, a continuous sidewall 18C, and a water-tight interior 18D. The height of the water basin sidewall 18C determines the maximum water level to which the water basin 18 may be filled. For most glass grinding applications, a sidewall height of about 1-2 inches should be sufficient.

Figure 12:
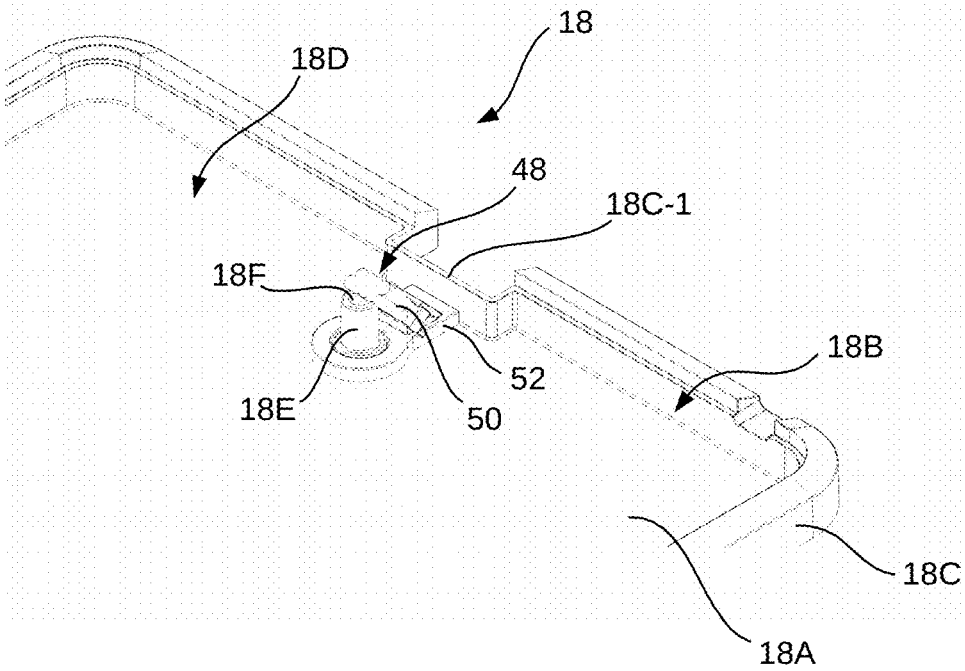
FIG. 12 is a partial upper perspective view of the water basin of FIG. 11, showing a bit wetting brush, a primary brush holder, and a motor shaft guide boss.
Figure 13:
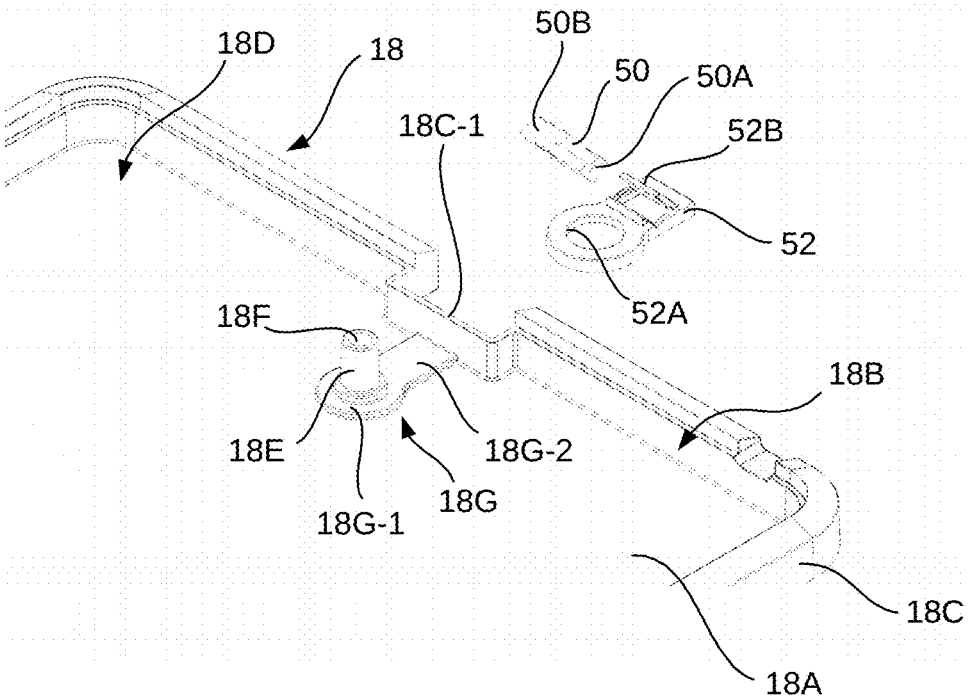
FIG. 13 is an exploded partial upper perspective view of the water basin of FIG. 11, separately showing the bit wetting brush, the brush holder and the motor shaft guide boss removed therefrom.

With additional reference to FIGS. 12 and 13, the water basin 18 may further include a raised motor shaft guide boss 18E having a central aperture 18F through which the grinding motor shaft 36 (not shown) may pass. The central aperture 18F represents a portion of the motor shaft aperture 40 of the work-piece support assembly 6 referred to above in connection with FIG. 7. The motor shaft guide boss 18E may be of the same height as the water basin sidewall 18C so that the motor shaft aperture 18F will be situated above a maximum water level in the water basin 18 to prevent water leakage therefrom.

The water basin 18 may additionally include a bit-lubricating device 48 arranged to deliver water in the water basin 18 to a grinding bit when the bit is mounted on the grinding motor shaft 36. In the illustrated embodiment, the bit-lubricating device 48 includes a bit wetting brush 50 having a base end 50A removably mounted to a brush holder 52 situated in the water basin interior 18D. A tip end 50B of the wetting brush 50 is positioned to engage the grinding bit and dispense water thereon that has been wicked upwardly from the base end 50A of the wetting brush 50. A similar wicking-type fluid transfer brush is disclosed in commonly-owned U.S. Pat. No. 6,994,613, mentioned in the "Background" section above.

As can be seen in FIG. 13, the brush holder 52 may be configured to removably engage a raised brush holder seating protrusion 18G formed on the bottom 18A of the water basin 18. The seating protrusion 18G may have a circular portion 18G-1 that surrounds the guide boss 18E, and a linear portion 18G-2 extending laterally therefrom to roughly define a key-hole-shaped configuration. The linear portion 18G-2 of the seating protrusion 18B will seen to extend to a small rectangular cutout 18C-1 of the water basin sidewall 18C. As may be seen by reference to FIG. 7, the cutout 18C-1 accommodates the lamp-shield support base 24D of the support tray cover 24.

Returning now to FIGS. 12 and 13, the brush holder 52 may have a lower cavity of substantially the same shape as the seating protrusion 18G, and a central aperture 52A that surrounds the base of the mounting boss 18E. The brush holder 52 will thus be seated securely in position on the seating protrusion 18G during grinding operations, allowing the brush holder to secure the wetting brush 48 against unwanted movement as the brush rubs against the rotating grinding bit. As best shown in FIG. 13, the brush holder 52 secures the wetting brush 48 by way of a brush-holding clip 52B to which the base end 50A of the brush may be removably attached.

Returning now to FIG. 7, the work-piece support grating may be configured to provide at least one water level view port 54 for indicating a level of water in the water basin 18. In the illustrated embodiment, there are two water level view ports 54 provided by two chamfers 20A formed on two corners of the work-piece support grating 24. Other water level view port configurations may also be used.

As shown in FIG. 11, the work-piece support grating 18 may further include a support grating aperture 20B through which the grinding motor shaft 36 (not shown) passes when the work-piece support assembly 6 is mounted on the motor housing 8. In the illustrated embodiment, the support grating aperture 20B is configured as a generally U-shaped slot. Removably covering the support grating aperture 20B is at least one bit guard 56 that may rest on a ledge portion 20B-1 (see FIG. 14) of the support grating aperture 20B. The bit guard 56 is shown in FIG. 11 to have an aperture 58 that may be sized to allow a grinding bit to extend below the bit guard when the grinding bit is mounted on the grinding motor shaft 36.

Figure 14:
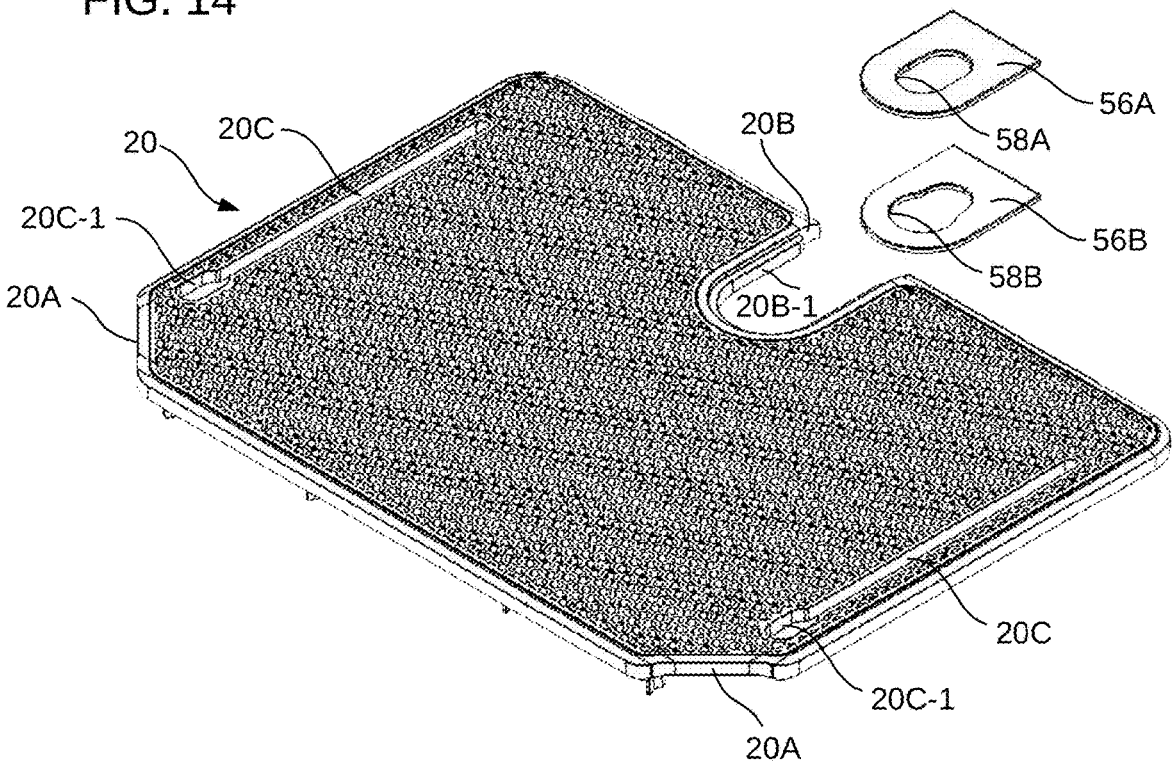
FIG. 14 is an exploded upper perspective view of the work-piece support grating of FIG. 11, showing a pair of upper and lower bit guards separated therefrom.

With additional reference to FIG. 14, the illustrated embodiment is shown as having two bit guards 56A and 56B that may be used together or at different times. The first bit guard 56A includes a first aperture 58A sized to accommodate grinding bits whose diameter is within a first size range. The second bit guard 56B includes a second aperture 58B sized to accommodate grinding bits whose diameter is within a second size range that is larger than the first size range. The support grating aperture 20B, the first bit guard aperture 58A, and the second bit guard aperture 58B represent additional portions of the motor shaft aperture 40 of the work-piece support assembly 6 referred to above in connection with FIG. 7.

As best shown in FIG. 14, the work-piece support grating 20 may further include a pair of parallel guide tracks 20C configured as slots to receive a work-piece guide (not shown). By way of example only, the work-piece guide could be a straight-edge guide that extends perpendicular to the guide tracks 20C. The ends of the straight-edge guide may slide along the guide tracks 20C, allowing a work-piece to be advanced toward a grinding bit during grinding operations. Enlarged openings 20C-1 may be formed at one end of each guide track 20C for insertion and removal of the work-piece guide. Advantageously, the work-piece guide may be configured to lock into the guide tracks 20C once the guide is advanced away from the openings 20C-1, thereby preventing the guide from lifting away from the work-piece support grating 20 during grinding operations.

Figure 15:
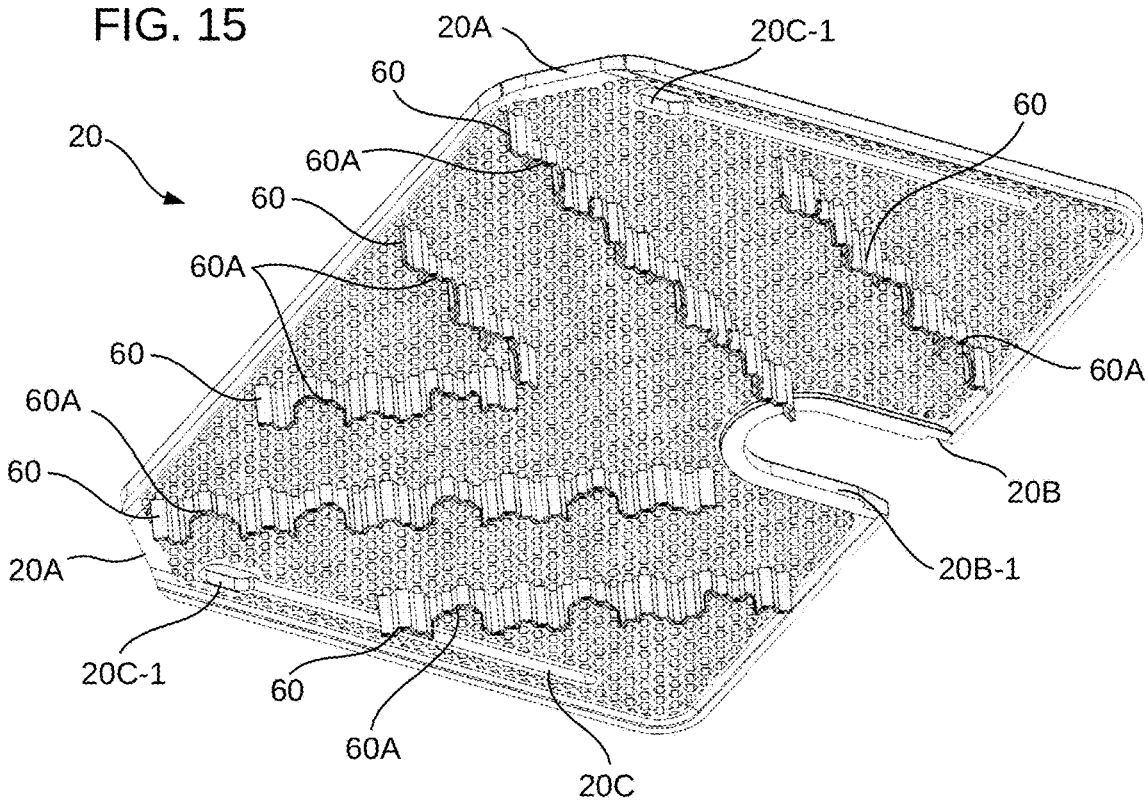
FIG. 15 is a lower perspective view of the work-piece support grating of FIG. 11, showing baffle elements thereon.

Turning now to FIG. 15, according to another aspect of the glass grinding apparatus 2, the work-piece support grating 20 may include plural water-restriction baffles 60 extending from an underside thereof. Advantageously, the baffles 60 serve to reduce water spillage from the water basin 18 when the water basin is removed from the motor housing assembly 8 and carried to or from a water source. In the illustrated embodiment, the baffles 60 are configured as corrugated wall structures having repeating corrugations that are each of selected longitudinal extent, and which are laterally angled relative to their immediately adjacent neighbor(s). Other configurations may also be used.

The baffles 60 may have a nominal height substantially equal to a maximum depth of the water that can be carried in the water basin 18. This nominal height may substantially correspond to the height of the water basin sidewall 18C (see FIG. 11). In that case, the baffles 60 will engage the bottom 18A of the water basin 18 and thereby serve as vertical support walls spanning interior portions of the work-piece support grating 20. Alternatively, the nominal height of the baffles 60 may be less than the height of the water basin sidewall 18C. In that case, the baffles 60 will not engage the bottom 18A of the water basin 18, but will nonetheless provide vertical bending support for the work-piece support grating 20 due to their beam-like configuration. In the illustrated embodiment, the baffles 60 are obliquely angled relative to the edges of the work-piece support grating 20. This orientation imparts two-dimensional structural rigidity and load-bearing capacity to the grating. Other orientations, such as zig-zag configurations in which the baffles 60 have sub-sections extending perpendicular to the edges of the work-piece support grating 20, could also be used, It will be seen in FIG. 15 that the baffles 60 may have longitudinally spaced regions 60A of reduced height relative to the nominal height of the baffles. It will be appreciated that when the work-piece support grating 20 is seated on the water basin 18 (as shown in FIG. 7), the reduced height regions 60A will be spaced from the bottom 18A of the water basin so as to provide water passages through which water in the water basin may flow transversely past the baffles 60 in a restricted manner. The advantageous effect of restricting water flow across the baffles 60 is to reduce the likelihood of water spillage while carrying the water basin 18 to and from a water source due to inertial forces induced by tipping or other movements.

According to another aspect of the glass grinding apparatus, the lamp-shield assembly 10 and the pedestal assembly 12 shown in FIGS. 1-6 may be removably mounted to the base unit assembly 4. This is shown in FIG. 16.

Figure 16:
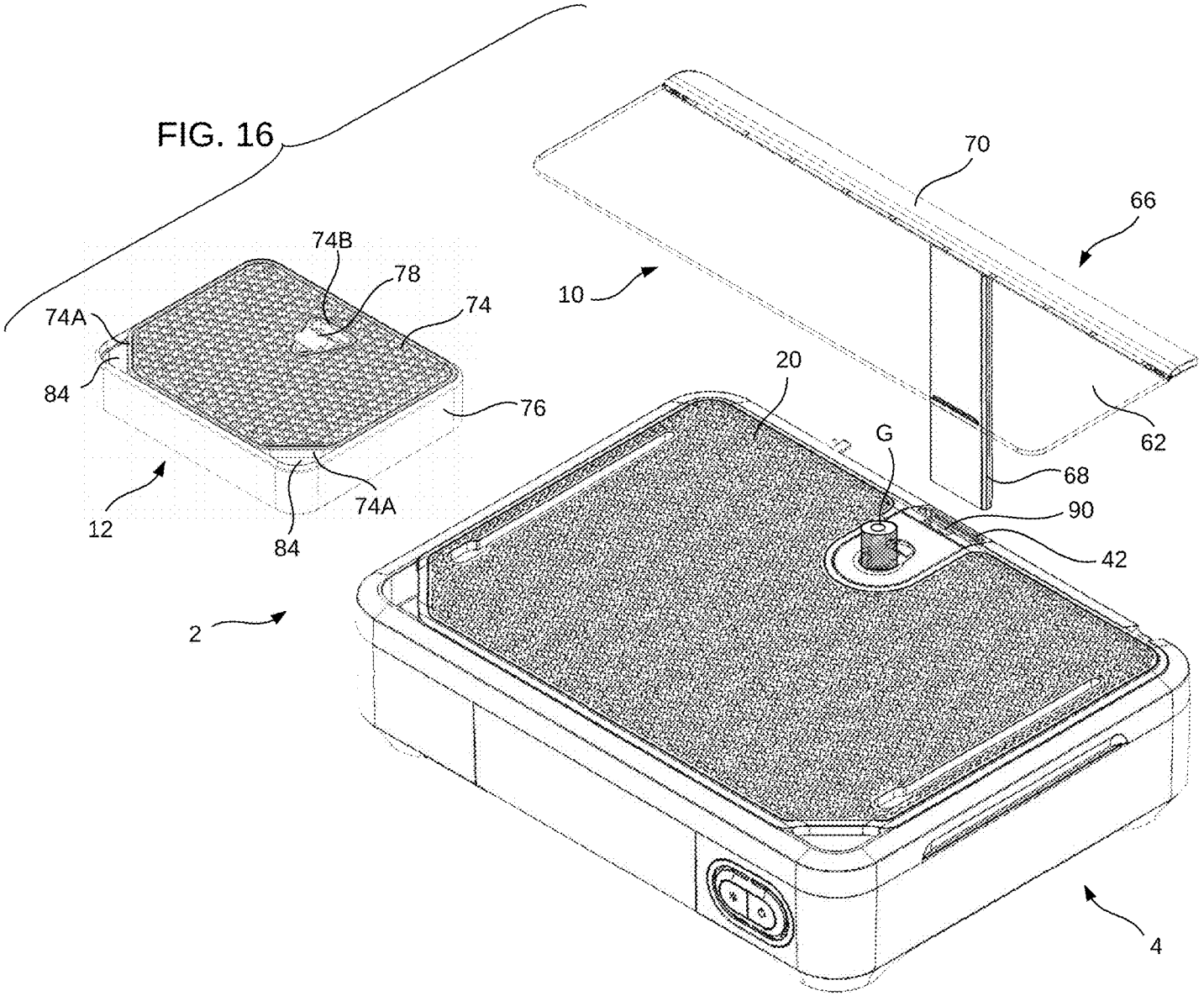
FIG. 16 is an exploded perspective view of the grinding apparatus of FIG. 1, showing an example pedestal assembly and an example lamp-shield assembly separated from the base unit assembly.
Figure 17:
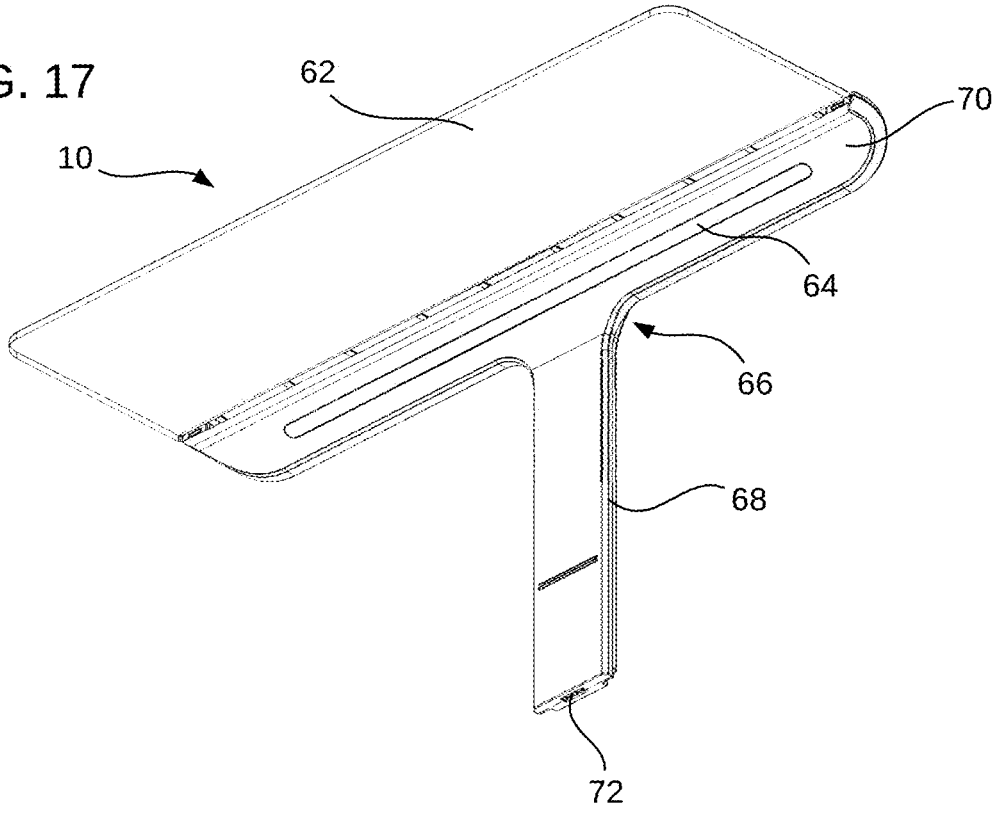
FIG. 17 is a lower perspective view of the lamp-shield assembly of FIG. 7.

FIG. 16, together with FIG. 17, further illustrates that the lamp-shield assembly 10 may include an eye shield 62 and a work-piece illumination lamp 64. The lamp-shield assembly 10 may be configured in various shapes. For example, in the illustrated embodiment, the lamp-shield assembly 10 is shown a including a generally T-shaped lamp-shield frame 66. The lamp-shield frame 66 includes a central upright frame member 68 configured to be slidably received in the previously-described lamp-shield receptacle 42 of the tray-cover 24 on the motor housing assembly 6. The lamp-shield frame 66 further includes a transverse frame member 70 extending orthogonally to the upright frame member 68.

As can be seen in FIG. 17, the upright frame member 68 includes an electrical connector 72 at a lower end thereof that releasably engages the electrical connector 44 disposed inside the motor housing 22 of the motor housing assembly 6. Internal wiring (not shown) within the lamp-shield assembly delivers electrical power from the electrical connector 72 to the lamp 64, which may be implemented as an elongated LED strip light. The lamp 64 is mounted on the same side of the transverse frame member 70 as the eye shield 62 so as to illuminate the work-piece support grating 20. The eye shield 62 itself may be formed as a transparent sheet that extends from the transverse frame member 70 in an orientation that is substantially parallel to the work-piece support grating 20. In an embodiment, some or all of the eye shield 62 may be configured to provide magnification.

Figure 18:
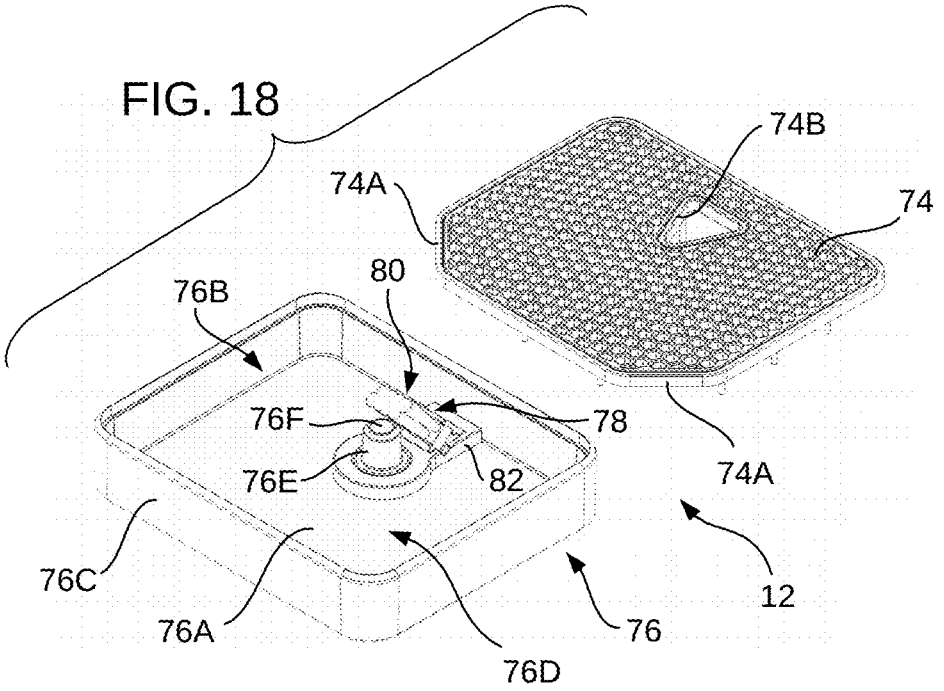
FIG. 18 is an exploded upper perspective view of the pedestal assembly of FIG. 7, showing a pedestal grating separated from a pedestal water basin.
Figure 19:
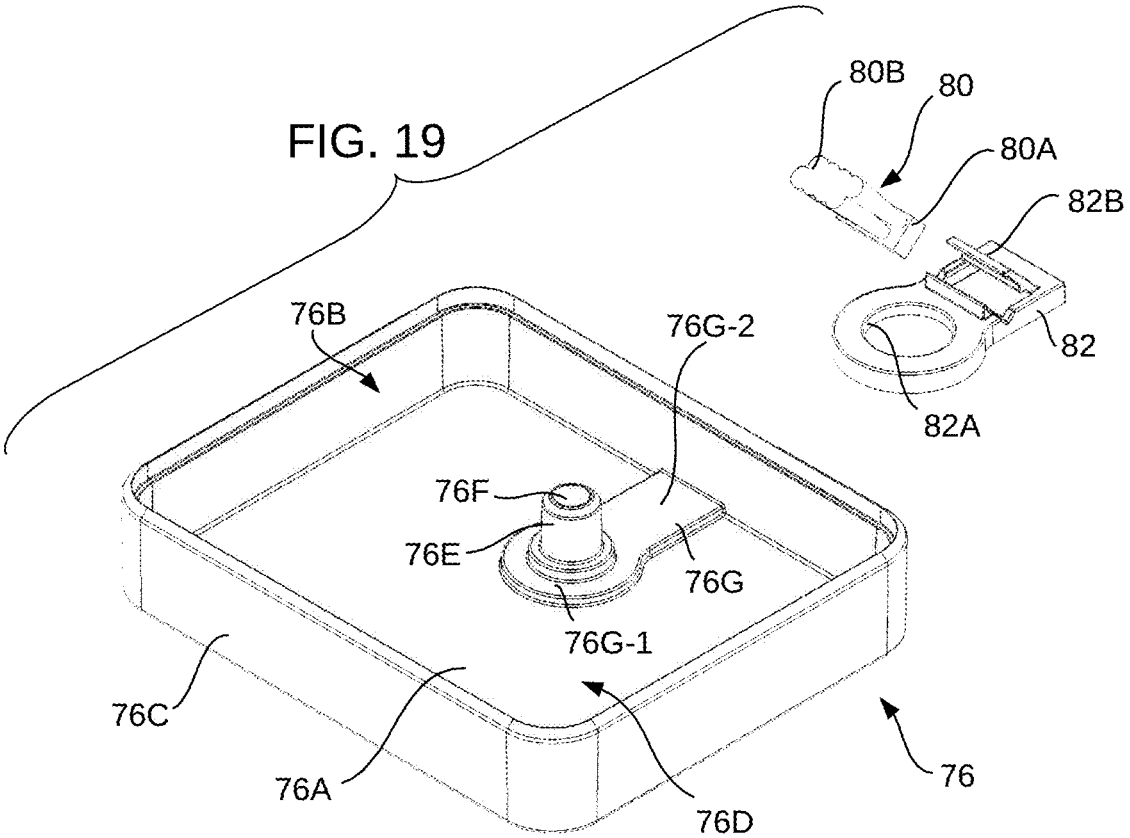
FIG. 19 is an exploded upper perspective view of the pedestal water basin of FIG. 18, further showing a pedestal bit wetting brush and a pedestal brush holder separated therefrom.
Figure 20:
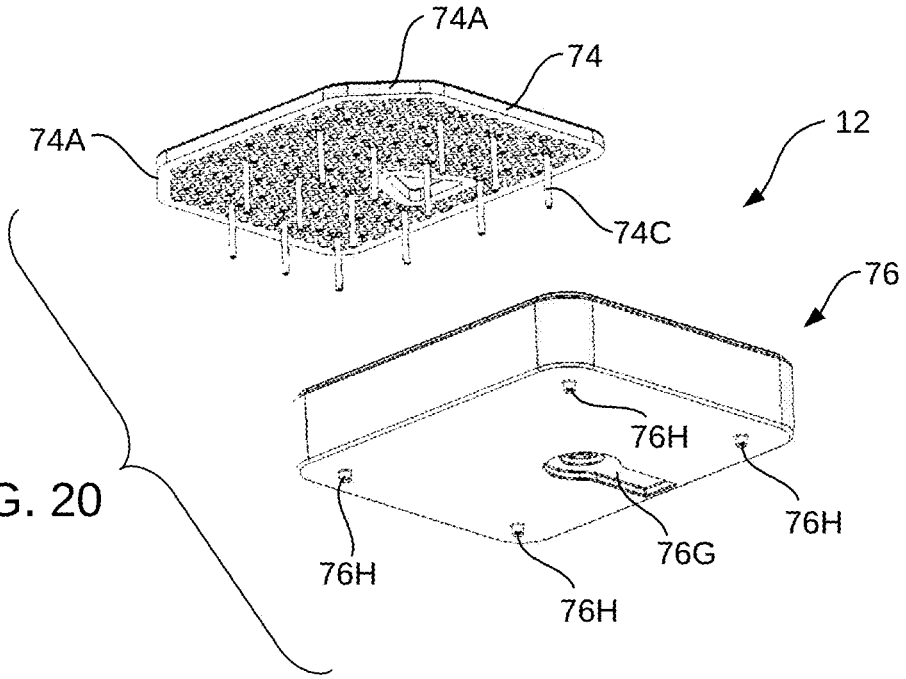
FIG. 20 is an exploded lower perspective view of the pedestal assembly of FIG. 18, showing features on the lower sides of the pedestal grating and the pedestal water basin.

With additional reference to FIGS. 18-20, the pedestal assembly 12 is removably mountable on the work-piece support assembly 6 and is intended for use when it is desired to grind a small work-piece using a reduced-size grinding bit (not shown). The pedestal assembly 12 represents a miniature version of the work-piece support assembly 6 insofar as it may include various corresponding components. In particular, the pedestal assembly 12 may include a pedestal work-piece support grating 74, a pedestal water basin 76, and a pedestal bit-lubricating device 78 arranged to deliver water in the pedestal water basin to the reduced-size grinding bit when the bit is mounted on the grinding motor shaft 36.

As can be seen in FIGS. 18-19, the pedestal water basin 76 may be configured as a generally rectangular tray structure having a substantially closed bottom 76A, an open top 76B, a continuous sidewall 76C, and a water-tight interior 76D. The height of the pedestal water basin sidewall 76C determines the maximum water level to which the pedestal water basin 76 may be filled. For most glass grinding applications, a pedestal sidewall height of about 1-2 inches should be sufficient.

The pedestal water basin 76 may further include a raised motor shaft guide boss 76E having a central aperture 76F through which the grinding motor shaft 36 (not shown) may pass. The motor shaft guide boss 76E may be of the same height as the pedestal water basin sidewall 76C so that the motor shaft aperture 76F will be situated above a maximum water level in the pedestal water basin 76 to prevent water leakage therefrom.

The pedestal water basin 76 may additionally include the pedestal bit-lubricating device 78, with the latter being arranged to deliver water in the pedestal water basin 76 to the reduced-size grinding bit when the bit is mounted on the grinding motor shaft 36. In the illustrated embodiment, the pedestal bit-lubricating device 78 includes a pedestal bit wetting brush 80 having a base end 80A removably mounted to a brush holder 82 situated in the pedestal water basin interior 76D. A tip end 80B of the pedestal bit wetting brush 80 is positioned to engage the reduced-size grinding bit and dispense water thereon that has been wicked upwardly from the base end 80A of the bit wetting brush. As can be seen in FIG. 19, the brush holder 82 may be configured to removably engage a raised brush holder seating protrusion 76G formed on the bottom 76A of the pedestal water basin 76. The seating protrusion 76G may have a circular portion 76G-1 that surrounds the guide boss 76E, and a linear portion 76G-2 extending laterally therefrom to roughly define a key-hole-shaped configuration. The linear portion 76G-2 of the seating protrusion 18B will seen to extend to the pedestal water basin sidewall 76C.

With continuing reference to FIG. 19, the brush holder 82 may have a lower cavity of substantially the same shape as the seating protrusion 76G, and a central aperture 82A that surrounds the base of the mounting boss 76E. The brush holder 82 will thus be seated securely in position on the seating protrusion 76G during grinding operations, allowing the brush holder to secure the wetting brush 80 against unwanted movement as the brush rubs against the rotating reduced-size grinding bit. The brush holder 82 may secure the bit wetting brush 80 by way of a brush-holding clip 82B to which the base end 80A of the brush may be removably attached.

As can be seen in FIGS. 18 and 20, the pedestal support grating 74 is removably mounted on the pedestal water basin 76. As additionally shown in FIG. 16, the pedestal support grating 74 may be further configured to provide at least one water level view port 84 for indicating a level of water in the pedestal water basin 76. In the illustrated embodiment, there are two water level view ports 84 provided by two chamfers 74A formed on two corners of the pedestal work-piece support grating 74. Other water level view port configurations may also be used.

As shown in FIG. 18, the pedestal work-piece support grating 74 may further include a support grating aperture 74B through which the reduced-size grinding bit (not shown) extends when the pedestal assembly 12 is seated on the work-piece support grating 20.

As shown in FIG. 20, the underside of the pedestal work-piece support grating 74 may include a plurality of vertical support members 74C that engage the bottom 76A of the pedestal water basin 76, and which thereby provide structural support for the pedestal work-piece support grating. As can be further seen in FIG. 20, the underside of the pedestal water basin 76 may be provided with a plurality of registration pins 76H that engage corresponding grate openings in the work-piece support grating 20. This prevents unwanted rotation or translation of the pedestal water basin 76 during grinding operations.

Figure 21:
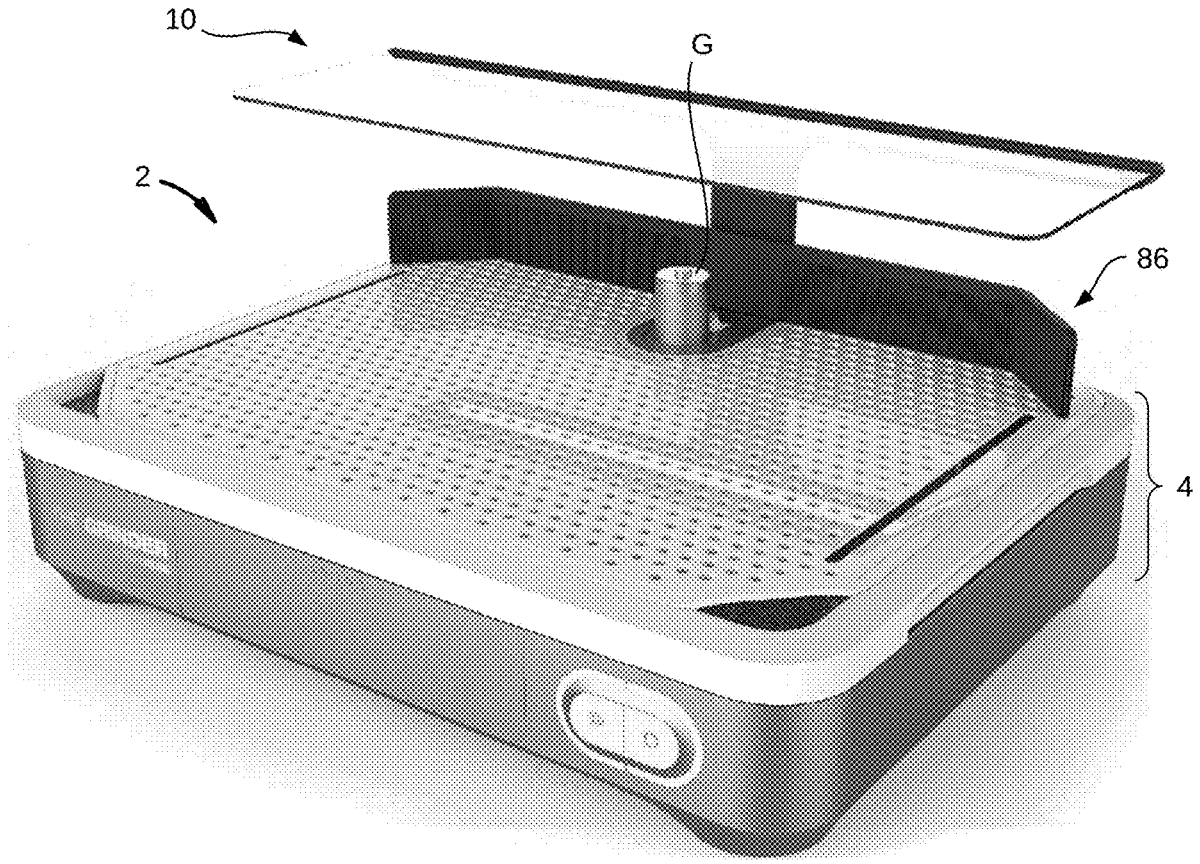
FIG. 21 is an upper perspective view of the grinding apparatus of FIG. 1 in a modified operational configuration without the pedestal assembly and using a splash curtain.

Turning now to FIG. 21, another aspect of the glass grinding apparatus is shown in which a splash guard assembly 86 is removably mounted on the base unit assembly 4. By way of example, the splash guard assembly 86 may be implemented as a splash curtain of the type disclosed in commonly-owned U.S. Pat. No. 6,994,613, mentioned in the "Background" section above. Other splash guard configurations may also be used. Although not shown, the splash guard assembly 86 may include a vertical mounting stem that is slidably received in a corresponding splash guard mounting slot 90 that may be formed adjacent to the lamp-shield receptacle 42 in the lamp-shield support base 24D of the support tray cover 24. The splash guard mounting slot 90 is shown in FIGS. 7, 8 and 16.

FIG. 21 further illustrates an example grinding bit 88 that may be used with the glass grinding apparatus 2. The grinding bit 88 many be of any suitable type, including as disclosed in commonly-owned U.S. Pat. No. RE38,742 or U.S. Pat. No. 7,125,328, the entire contents of each of which are incorporated herein by this reference.

Accordingly, a glass grinding apparatus has been disclosed. While various embodiments have been described, it should be apparent that many variations and alternative embodiments could be implemented in accordance with the invention. It is understood, therefore, that an invention as disclosed herein is not to be in any way limited except in accordance with the spirit of the appended claims and their equivalents.

What is claimed is:

1. A glass grinding apparatus, comprising:

a base unit assembly;

said base unit assembly including a work-piece support assembly and a motor housing assembly;

said work-piece support assembly including a work-piece support grating and a water basin;

said motor housing assembly including a motor housing having disposed therein a grinding motor and a power supply;

said grinding motor having a rotatable motor shaft extending upwardly from said motor housing assembly through an aperture in said work-piece support assembly, said motor shaft having an upper end configured to receive a glass grinding bit that is operable to grind a glass work-piece when said work-piece is situated on said support grating; and said grinding motor being a direct current motor and said power supply being a direct current power supply operable to convert alternating current from different utility mains having different voltage and frequency characteristics into direct current at a substantially uniform voltage for powering said direct current motor.

2. The glass grinding apparatus of claim 1, wherein said direct current motor is operable to spin said motor shaft at approximately 5000 rpm or more at a torque of approximately 0.6 N-m or more without gearing.

3. The glass grinding apparatus of claim 1, wherein said direct current power supply is operable to convert alternating current ranging between approximately 110-220 volts and 50-60 cycles into direct current having a voltage of approximately 24 volts.

4. The glass grinding apparatus of claim 1, wherein said water basin includes handles for lifting and carrying, and wherein said work-piece support assembly rests on said motor housing assembly and is removable therefrom by way of lifting in order to allow said water basin to be carried to a water source for filling with water without having to carry said motor housing assembly.

5. The glass grinding apparatus of claim 1, wherein said water basin includes a raised motor shaft guide boss having an aperture through which said motor shaft passes, said aperture being situated above a maximum water level in said water basin to prevent water leakage therefrom.

6. The glass grinding apparatus of claim 4, wherein said handles are configured as finger grooves.

7. The glass grinding apparatus of claim 1, further including a bit-lubricating device arranged to deliver said water in said water basin to said grinding bit when said bit is mounted on said motor shaft, said bit-lubricating device including a wetting brush having a base end removable mounted to a brush holder situating in said water basin, and a tip end positioned to engage said grinding bit, said brush holder removably engaging a raised brush holder seating protrusion formed on a bottom of said water basin.

8. The glass grinding apparatus of claim 1, wherein said support grating is configured to provide at least one water level view port for indicating a level of water in said water basin.

9. The glass grinding apparatus of claim 8, wherein said at least one water level view port is provided by a chamfer formed on a corner of said support grating.

10. The glass grinding apparatus of claim 9, wherein there are two of said chamfers on said support grating providing two water level view ports.

11. The glass grinding apparatus of claim 1, wherein said support grating includes a support grating aperture through which said motor shaft passes, and wherein said work-piece support assembly further includes at least one bit guard removably covering said support grating aperture, said bit guard having an aperture sized to allow said grinding bit to extend below said bit guard when said grinding bit is mounted on said motor shaft.

12. The glass grinding apparatus of claim 1, wherein said support grating includes plural water-restriction baffles extending from an underside thereof for reducing water spillage from said water basin when said water basin is removed from said motor housing assembly.

13. The glass grinding apparatus of claim 12, wherein said baffles are configured as corrugated wall structures having a nominal height substantially equal to a maximum depth of said water that can be carried in said water basin, said wall structures further having longitudinally spaced regions of reduced height through which said water may flow in a restricted manner, said wall structures being angled to impart two-dimensional structural rigidity and load-bearing capacity to said support grating.

14. The glass grinding apparatus of claim 1, wherein said support grating includes parallel guide tracks configured to receive a work-piece guide.

15. The glass grinding apparatus of claim 1, further including a lamp-shield assembly mounted on said base unit assembly, said lamp-shield assembly including an eye shield and a work-piece illumination lamp.

16. The glass grinding apparatus of claim 15, wherein said lamp-shield assembly includes a generally T-shaped lamp-shield frame having a central upright frame member slidably received in a corresponding receptacle on said motor housing assembly, and a transverse frame member extending orthogonally to said upright frame member.

17. The glass grinding apparatus of claim 16, wherein said upright frame member includes an electrical connector at a lower end thereof that releasably engages an electrical connector disposed inside said motor housing assembly.

18. The glass grinding apparatus of claim 16, wherein said lamp-shield frame includes an elongated strip light on said transverse frame member.

19. The glass grinding apparatus of claim 16, wherein said eye shield includes a transparent sheet extending from said transverse frame member substantially parallel to said support grating, with some or all of said transparent sheet providing magnification.

20. The glass grinding apparatus of claim 1, further including a pedestal assembly removably mounted on said work-piece support assembly for use when grinding a work-piece using a reduced-size grinding bit, said pedestal assembly including a pedestal work-piece support grating, a pedestal water basin, and a bit-lubricating device arranged to deliver said water in said pedestal water basin to said reduced-size grinding bit when said bit is mounted on said motor shaft.

21. The glass grinding apparatus of claim 20, wherein said pedestal water basin includes a raised motor shaft guide boss having an aperture through which said motor shaft passes, said aperture being situated above a maximum water level in said pedestal water basin to prevent water leakage therefrom.

22. The glass grinding apparatus of claim 20, wherein said pedestal bit-lubricating device includes a wetting brush having a base end removable mounted to a brush holder situating in said pedestal water basin, and a tip end positioned to engage said reduced-size grinding bit, said pedestal brush holder removably engaging a raised brush holder seating protrusion formed on a bottom of said pedestal water basin.

23. The glass grinding apparatus of claim 20, wherein said pedestal support grating is removably mounted on said pedestal water basin, and has a pedestal support grating aperture through which said reduced-size grinding bit passes, and further wherein said pedestal support grating is configured to provide at least one water level view port for indicating a level of water in said water basin, said at least one water level view port being provided by at least one chamfer formed on a corner of said pedestal support grating.

24. The glass grinding apparatus of claim 1, wherein said motor housing assembly further includes a support tray cover removably mounted on said motor housing, said support tray cover having an aperture through which said motor shaft passes, and a mounting boss formed with a receptacle for mounting a lamp-shield assembly.

* * * * *